US008430478B2

(12) United States Patent
Goto et al.

(10) Patent No.: US 8,430,478 B2
(45) Date of Patent: Apr. 30, 2013

(54) INK-JET RECORDING APPARATUS

(75) Inventors: Kazuma Goto, Nagoya (JP); Noriaki Satoh, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 316 days.

(21) Appl. No.: 12/847,694

(22) Filed: Jul. 30, 2010

(65) Prior Publication Data

US 2010/0295893 A1 Nov. 25, 2010

Related U.S. Application Data

(62) Division of application No. 11/531,838, filed on Sep. 14, 2006, now Pat. No. 7,789,481.

(30) Foreign Application Priority Data

Sep. 22, 2005 (JP) ..... 2005-274977

(51) Int. Cl.
*B41J 2/165* (2006.01)

(52) U.S. Cl.
USPC ..... 347/29

(58) Field of Classification Search ..... 347/29
See application file for complete search history.

(56) References Cited

U.S. PATENT DOCUMENTS 3,008,915 A 11/1961 Fusco et al.
5,517,219 A * 5/1996 Uchida ..... 347/24
5,990,204 A * 11/1999 Onizawa ..... 523/457
2005/0116984 A1 6/2005 Tsuda et al.
2006/0028519 A1 2/2006 Nakamura et al.

FOREIGN PATENT DOCUMENTS

| | | |
|---|---|---|
| JP | 7329309 | 12/1995 |
| JP | HEI 10-029381 A | 2/1998 |
| JP | 10250086 | 9/1998 |
| JP | 2000-086839 A | 3/2000 |
| JP | 2004-181790 A | 7/2004 |
| JP | 2005119288 | 5/2005 |
| JP | 200627003 | 2/2006 |

OTHER PUBLICATIONS

Notice of Reasons for Rejection (Office Action) for counterpart Japanese Patent Application No. 2005-274977, mailed Aug. 11, 2010, with partial English translation of Notice.

* cited by examiner

*Primary Examiner* — Kevin S Wood
(74) *Attorney, Agent, or Firm* — Banner & Witcoff, Ltd.

(57) ABSTRACT

An ink-jet recording apparatus includes a rubber member in an ink flow passage. The rubber member is made of a rubber composition including a rubber base polymer selected from ethylene-propylene diene rubber polymer and isobutylene-isoprene rubber polymer, and at least one trapping agent selected from calcium carbonate, silicon dioxide, talc, and clay. The trapping agent is effective for absorb-trapping various types of additives that may be present in the rubber member. The additives in the rubber are thereby held in the rubber structure and prevented from being eluted into the water-based ink or the preservative solution, which can lead to clogging of ink nozzles and the like.

11 Claims, No Drawings

INK-JET RECORDING APPARATUS

CROSS REFERENCE TO RELATED APPLICATIONS

This is a division of U.S. application Ser. No. 11/531,838, filed Sep. 14, 2006, which claims priority to Japanese Patent Application No. 2005-274977, filed Sep. 22, 2005, the entire disclosures of which are hereby incorporated by reference.

BACKGROUND

An ink-jet recording apparatus functions by allowing ink to adhere to a recording material, such as recording paper, by means of an ink discharge method. One example is a thermal method, which generates bubbles and pressure by rapid heating, and then discharges fine droplets of the ink from a fine nozzle. Another example is a piezoelectric method, which discharges fine droplets of ink using a piezoelectric element.

In an ink-jet recording apparatus, rubber members usually are used in ink flow passages containing an ink tank or an ink-jet head. Common examples of such rubber members include a cap for covering an ink head nozzle, a wiper for cleaning an end face of an ink head nozzle, a seal packing to be pinched between parts at a juncture, and a tube for supplying the ink from the ink tank to an ink-jet head.

A rubber base polymer usually is used in the rubber members, such as an ethylene-propylene diene rubber polymer (EPDM) or an isobutylene-isoprene rubber polymer (IIR). The rubber members usually are formed by compounding the non-crosslinked rubber base polymer with one or more additives such as a vulcanization agent, a vulcanization accelerator, a lubricant, a softening agent, a filler, and the like. This rubber composition is then molded into the rubber members using conventional techniques.

When conventional rubber members come into contact with the ink used in the ink-jet recording or a preservative solution filled in the ink flow passage at the time of shipping or storage, an additive contained in the rubber member can be eluted into the ink or the preservative solution. The eluted additive can be deposited as insoluble matter, thereby causing clogging of the nozzle of the ink-jet head or the like.

One effort to address this problem is disclosed in U.S. Publication No. 2005/0116984 A1, which provides a method in which the rubber member is dipped in water at 60° C. in a hermetically-sealed container for a predetermined period of time. The amount of eluted material is measured, so that rubber materials that elute lower amounts of insoluble matter can be identified.

The type or amount of insoluble matter precipitated by an ink or a preservative solution may vary depending on such factors as the composition of the ink or preservative solution. Even when a rubber material selected by the method described in U.S. Publication No. 2005/0116984 A1 is used in the rubber member, insoluble matter still may be eluted from the rubber member. This can happen, for example, when an ink composition is adjusted to have preferable dynamic surface tension from the standpoint of discharge stability, or a preservative solution composition is adjusted to have a preferable dynamic surface tension from the standpoint of a wetting property or ease of replacement with the ink.

SUMMARY

An ink-jet recording apparatus includes a rubber member in an ink flow passage. The rubber member is made of a rubber composition having a rubber base polymer and at least one trapping agent. The trapping agent is effective for absorb-trapping various types of additives that may be present in the rubber member. The additives in the rubber are thereby held in the rubber structure and prevented from being eluted into the ink or the preservative solution, which can lead to clogging of ink nozzles and the like.

DETAILED DESCRIPTION

General Overview

In one aspect, an ink-jet recording apparatus includes a rubber member in the ink flow passage(s). The composition of the rubber member is selected to prevent or minimize precipitation of insoluble matter when contacted with ink or a preservative solution.

It was discovered that when calcium carbonate, silicon dioxide, talc or clay is contained in the rubber member, it acts as a trapping agent for absorb-trapping various types of additives contained in the rubber member. The additives in the rubber are thereby held in the rubber structure and prevented from being eluted into the ink or the preservative solution.

Aspects of the invention include an ink-jet recording apparatus in which an ink flow passage comprises a rubber composition containing an ethylene-propylene diene rubber polymer (EPDM), and a trapping agent selected from calcium carbonate, silicon dioxide, talc, clay, and combinations thereof. The amount of trapping agent usually is in an amount of from about 10 to about 80 parts by weight, based on 100 parts by weight of the ethylene-propylene diene rubber polymer. Further, aspects of the invention include an ink-jet recording apparatus in which an ink flow passage comprises a rubber composition containing an isobutylene-isoprene rubber polymer (IIR), and a trapping agent selected from calcium carbonate, silicon dioxide, talc, clay, and combinations thereof. The amount of trapping agent usually is in an amount of from about 5 to about 40 parts by weight, based on 100 parts by weight of the isobutylene-isoprene rubber polymer.

Fillers, such as carbon black, are sometimes added to reinforce rubber. Because the trapping agents described herein have a reinforcing effect on rubber, the need for a filler may be avoided or the amount of filler needed may be reduced when the trapping agents are used.

Illustrative Aspects of the Invention

The ink-jet recording apparatus according to aspects of the invention is characterized in that a rubber member used in ink flow passage(s) has a specified composition. Other components of the ink-jet recording apparatus can be of conventional construction. There is no limitation on ink discharge methods. A thermal method, a piezoelectric method, or any other method can be used.

Non-limiting examples of rubber members used in the ink flow passage include a cap for covering a nozzle of an ink-jet head, a wiper for cleaning an end face of the nozzle, a tube which supplies the ink from an ink tank to the ink-jet head, and a seal packing which is an elastic member to be pinched between a buffer tank and a head unit as disclosed in the specification in Japanese Patent Application No. 2004-207208.

The rubber member generally includes at least one rubber base polymer, examples of which include ethylene-propylene diene rubber polymer (EPDM) and isobutylene-isoprene rubber polymer (IIR). An ethylene-propylene diene rubber polymer represented by the following formula is preferred from the standpoint of exhibiting a sliding property:

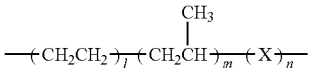

wherein X represents a nonconjugated diene compound such as ethylydene norbornene, dicyclopentadiene, 1,4-hexadiene, and the like.

As for such rubber base polymers, commercially available products can be used. Examples of ethylene-propylene diene rubber polymers include EP331 (JSR Corporation), ESPRENE 505® (Sumitomo Chemical Co., Ltd.), and the like. Examples of isobutylene-isoprene rubber polymers include HT-1066® and HT-1068® (JSR Corporation), and the like.

According to aspects of the invention, the rubber composition which forms the rubber member comprises at least one trapping agent selected from calcium carbonate, silicon dioxide, talc, and clay. These trapping agents each can absorb-trap various types of additives, such as a vulcanization accelerator, a lubricant, a softening agent and the like, and then allow them to be held in the rubber structure. The additives are thereby prevented from being eluted from the rubber member into the ink or preservative solution when the rubber member comes in contact with the ink or preservative solution. Among these trapping agents, calcium carbonate has a particularly good trapping effect.

The amount of the trapping agent used in the rubber may vary over a wide range depending on the type of the base rubber polymer, the types and amounts of additives in the rubber, and the type of trapping agent used. In general, the amount of trapping agent should be at least a minimum amount, below which the strength of the rubber may become insufficient. The amount of trapping agent should not be above a maximum amount, above which physical properties such as rubber hardness or rubber elasticity may be adversely affected. By way of example, when the rubber base polymer is an ethylene-propylene diene rubber polymer, the total amount of trapping agent usually ranges from about 10 to about 80 parts by weight, based on 100 parts by weight of the ethylene-propylene diene rubber polymer. When the rubber base polymer is isobutylene-isoprene rubber polymer, the total amount of trapping agent usually ranges from about 5 to about 40 parts by weight, based on 100 parts by weight of the isobutylene-isoprene rubber polymer.

Calcium carbonate was found to be a particularly effective trapping agent for a wide range of ink compositions. The amount of calcium carbonate used usually ranges from about 60 to about 80 parts by weight, based on 100 parts of ethylene-propylene diene rubber polymer, or from about 30 to about 40 parts by weight, based on 100 parts of isobutylene-isoprene rubber polymer.

Rubber members used in the ink flow passage that include a rubber base polymer and a trapping agent as described herein are effective for preventing elution of various types of additives. Examples of such additives include, without limitation, a vulcanization agent such as zinc oxide, sulfur, an organic peroxide, and the like; a vulcanization accelerator such as a thiazole type compound, a thiourea type compound, a thiuram type compound, a sulfenamide type compound, dithiocarbamic acid type compound, and the like; a lubricant such as fatty acid salts such as calcium stearate, zinc stearate, magnesium stearate, and the like, fatty acid derivatives such as stearic amide, oleic amide, erucic amide, and the like, magnesium oxide; a filler such as carbon black; a softening agent such as paraffin oil; and an scorch retarder.

Stearic salts such as calcium stearate, zinc stearate, and magnesium stearate are likely to be held in the rubber structure when a calcium carbonate, silicon dioxide, talc, and/or clay trapping agent is added into the rubber. The stearic salts are strongly held in the rubber structure when the trapping agent includes calcium carbonate.

The total amount of vulcanization accelerator and lubricant usually in an amount of about 50 wt % or less, based on a total weight of the trapping agent. When the total amount of the vulcanization accelerator and the lubricant is more than about 50 wt % of the total weight of the trapping agent, it becomes difficult to securely prevent elution of the vulcanization accelerator or the lubricant when the ink or preservative solution has relatively high permeability.

Carbon black is often used as a reinforcing agent in rubber. However, because each of calcium carbonate, silicon dioxide, talc, and clay has a reinforcing effect on rubber, the trapping agent can be used to replace all or a portion of carbon black conventionally used as a reinforcing agent.

The rubber member can be prepared by kneading the components using, for example, a banbury mixer, a kneader, or a pair of rolls. The resultant article then can be subjected to a rubber heat-forming treatment, ordinarily at from about 140 to about 200° C. for a period of from about 5 to about 15 minutes. When an ethylene-propylene diene rubber polymer or the like is used as the rubber base polymer, a heat-forming treatment is usually performed at from about 160 to about 180° C. for a period of from about 5 to about 13 minutes, and then a heating treatment at from about 100 to about 150° C. for a period of from about 1 to about 24 hours. By these treatments, unreacted organic peroxide and the like can be removed, thereby slightly increasing hardness. When the heating treatment is performed at unduly high temperatures and/or for too a long period of time, the rubber can be unfavorably scorched.

A wide variety of compositions of water-based ink or preservative solution can be used. Water-based ink compositions usually include a coloring agent, water, and a water-soluble organic solvent. Non-limiting examples of coloring agents include a dye, such as a direct dye, an acid dye, a basic dye, a reactive dye and the like; a pigment; or a self-dispersing type pigment having a surface treated with a hydrophilic treatment. The water-soluble organic solvent often contains a penetrant to increase the penetrating speed of the water-based ink and enhance the drying property thereof, and/or a humectant to prevent the water-based ink from drying at the nozzle and to enhance liquid stability.

Examples of penetrants include, but are not limited to, glycol ethers such as diethylene glycol methyl ether, diethylene glycol butyl ether, diethylene glycol isobutyl ether, dipropylene glycol methyl ether, dipropylene glycol propyl ether, dipropylene glycol isopropyl ether, dipropylene glycol butyl ether, triethylene glycol methyl ether, triethylene glycol butyl ether, tripropylene glycol methyl ether, tripropylene glycol butyl ether, and the like.

Examples of humectants include, but are not limited to, polyhydric alcohols such as ethylene glycol, propylene glycol, diethylene glycol, triethylene glycol, dipropylene glycol, polyethylene glycol, polypropylene glycol, 1,3-butanediol, 1,5-pentanediol, 1,6-hexanediol, glycerin, 1,2,6-hexanetriol, 1,2,4-butanetriol, 1,2,3-butanetriol and the like; nitrogen-containing heterocyclic compounds such as N-methyl-2-pyrrolidone, N-hydroxyethyl-2-pyrrolidone, 2-pyrrolidone, 1,3-dimethylimidazoline, ε-caprolactam and the like; amides such as formamide, N-methyl formamide, N,N-dimethyl formamide and the like; amines such as ethanol amine, diethanol amine, triethanol amine, ethyl amine, diethyl amine, triethyl amine and the like; sulfur-containing compounds such as dimethyl sulfoxide, sulfolane, thiodiethanol, and the like.

The water-soluble organic solvent may be, or include, a monohydric alcohol such as ethanol, isopropyl alcohol and the like, for the purpose of controlling permeability of the ink into the material on which it is recorded as well as the ink's drying properties.

The composition of the preservative solution can be selected in accordance with the composition of the water-based ink. In many cases, the composition of the preservative solution does not contain a coloring agent. The composition sometimes includes a polymer, a surfactant, or the like, which is not present in water-based inks.

In addition, a dispersing agent, a viscosity modifier, a surfactant, a pH modifier, a shipping preservative, a mildew-proofing agent or the like can optionally be added in the water-based ink or preservative solution.

EXAMPLES (1) Preparation of Inks

Inks 1 to 3 in Table 1 were obtained by stir-mixing individual components. Further, penetration force of these inks to the rubber were in the order of ink 1>ink 2>ink 3.

(2) Preparation of Rubber Sheets

Individual components were sequentially loaded in a rubber mixer in accordance with a composition shown in Table 2, kneaded and discharged. The resultant article was extruded in a sheet state by using a twin screw extruder, loaded in a metallic mold and subjected to a heat-forming treatment (170° C. for 10 minutes), to thereby obtain rubber sheets 1 to 20.

(3) Insoluble Compound Evaluation

The rubber sheets obtained in (2) were each cut in sizes of 50 mm length, 10 mm width and 2 mm thickness, to prepare a rubber samples for evaluation.

Combinations (experiment examples 1 to 60) of rubber samples for evaluation and inks were prepared as shown in Table 3, and then one sheet of the rubber sample was dipped in 10 ml of the ink in a hermetically-sealed container and was left to stand in a thermostatic oven for two weeks at 60° C. Thereafter, the thus-dipped rubber sample was taken up and the remaining ink was filtered by using an electroformed filter (pore diameter of 13 μm; effective filtering area of 8 $cm^2$) to measure a time required for filtering. For comparison, the ink in which the rubber sample was not dipped was left to stand under same conditions (two weeks at 60° C.), filtered by using an electroformed filter having same specifications to measure a time (a reference time) required for filtering. Then, a ratio of the time required for filtering the ink in which the rubber sample was dipped to the reference time was determined, and then evaluated in accordance with the following criteria. The results are shown in Table 3 and 4:

AA: Filtering time of less than 130% of the reference time was required.

A: Filtering time of from 130% to less than 200% of the reference time was required.

B: Filtering time of from 200% to less than 400% of the reference time was required.

C: Filtering time of 400% or more of the reference time was required.

Upon examining the electroformed filter used in filtering, it was found that as the ratio of filtering time to reference time increased, the amount of the insoluble compounds also increased.

TABLE 1

(wt %)

| | Ink No. | | |
|---|---|---|---|
| | 1 | 2 | 3 |
| CAB-O-JET ® 300*1 | 30 | — | — |
| C.I. Direct Yellow 86 | — | 2 | — |
| C.I. Direct Blue 199 | — | — | 3 |
| Glycerin | 17 | 25 | 22 |
| Triethylene glycol-n-butyl ether | 4.5 | — | 0.8 |
| Dipropylene glycol-n-propyl ether | — | 0.9 | — |
| OLFINE ® E1010*2 | 0.2 | 0.1 | — |
| SUNNOL ® NL-1430*3 | 0.05 | 0.2 | 0.05 |
| Proxel XL-2(S)*4 | 0.2 | 0.2 | 0.1 |
| Water | balance | balance | balance |

*1Coloring agent, solid content: 15% by weight: Cabot Corporation
*2Acetylene glycol type surfactant: Nisshin Chemical Industry Co., Ltd.
*3Polyoxyethylene alkyl ether sulfate type surfactant: Lion Corporation
*4Mildew-proofing agent: Arch Chemicals, Inc.

TABLE 2

(unit: parts by weight)

| | | Rubber No. | | | | | | | | | |
|---|---|---|---|---|---|---|---|---|---|---|---|
| | | 1 | 2 | 3 | 4 | 5 | 6 | 7 | 8 | 9 | 10 |
| Polymer | Ethylene propylene diene rubber polymer*1 | 100 | 100 | 100 | 100 | 100 | 100 | 100 | 100 | 100 | 100 |
| | Isobutylene isoprene rubber polymer*2 | | | | | | | | | | |
| Vulcanization agent | Zinc oxide | 5 | | 5 | 5 | 5 | 5 | | 5 | 5 | 5 |
| | Sulfur | 1 | 1.5 | 1.5 | 1 | 1.5 | 1 | 1 | 1.5 | 1 | 1 |
| | Dicumyl peroxide | | 2.7 | | | | | 2.7 | | | |
| Vulcanization accelerator | Benzothiazyl disulfide | | 1.5 | | | | | 1.5 | | 1.5 | |
| | N,N-dicyclohexyl benzothiazyl-2-sulfenamide | | | | 1 | | 1 | | | | |
| | Tetramethyl thiuram disulfide | 1 | | | | 1 | | | | | 1 |
| | Zinc diethyl dithiocarbamate | | | 1 | | | | | 1 | | |
| Lubricant | Calcium stearate | 1 | 1.5 | | | 1 | 1 | 1 | | 1.5 | 1 |
| | Stearic amide | | | 1 | | | | | 1.5 | | |
| | Magnesium oxide | | | | 1 | | | | | | |
| Trapping agent | Calcium carbonate | 80 | 40 | 60 | 40 | | | | | 5 | |
| | Silicon dioxide | | | | | 10 | | | 30 | | |
| | Talc | | | | | | 20 | | | | |
| | Clay | | | | | | | 25 | | | |
| Filler | Carbon black | | 40 | 20 | 40 | 70 | 50 | 50 | 50 | 75 | 100 |

TABLE 2-continued (unit: parts by weight)

| | | | | | | | | | | | |
|---|---|---|---|---|---|---|---|---|---|---|---|
| Softening agent | Paraffin oil | 30 | 30 | 30 | 30 | 30 | 30 | 30 | 30 | 30 | 30 |
| | (Vulcanization accelerator + lubricant)/trapping agent (%) | 2.5 | 7.5 | 3.3 | 5.0 | 20.0 | 10.0 | 10.0 | 8.3 | 60.0 | — |

| | | Rubber No. | | | | | | | | | |
|---|---|---|---|---|---|---|---|---|---|---|---|
| | | 11 | 12 | 13 | 14 | 15 | 16 | 17 | 18 | 19 | 20 |
| Polymer | Ethylene propylene diene rubber polymer*1 | | | | | | | | | | |
| | Isobutylene isoprene rubber polymer*2 | 100 | 100 | 100 | 100 | 100 | 100 | 100 | 100 | 100 | 100 |
| Vulcanization agent | Zinc oxide | 5 | 5 | 5 | 5 | 5 | 5 | 5 | 5 | 5 | 5 |
| | Sulfur | | | | | | | | | | |
| | Dicumyl peroxide | | | | | | | | | | |
| Vulcanization accelerator | Benzothiazyl disulfide | 1.5 | | | | | | | | 1 | |
| | N,N-dicyclohexyl benzothiazyl-2-sulfenamide | | | | 1 | | | 1 | | | |
| | Tetramethyl thiuram disulfide | | 1.5 | | | 1.5 | | | 1.5 | | 1.5 |
| | Zinc diethyl dithiocarbamate | | | 1 | | | 1 | | | | |
| Lubricant | Calcium stearate | 1 | | 1 | | 1 | 1.5 | 1 | | | 1 |
| | Stearic amide | | 1 | | | | | | | 1 | |
| | Magnesium oxide | | | | 1 | | | | 1 | | |
| Trapping agent | Calcium carbonate | 40 | 30 | 25 | | | | | | | |
| | Silicon dioxide | | | | 20 | | | | | 3 | |
| | Talc | | | | | 20 | | 10 | | | |
| | Clay | | | | | | 15 | | 5 | | |
| Filler | Carbon black | | 10 | 15 | 20 | 20 | 25 | 30 | 40 | 40 | 50 |
| Softening agent | Paraffin oil | 30 | 30 | 30 | 30 | 30 | 30 | 30 | 30 | 30 | 30 |
| | (Vulcanization accelerator + lubricant)/trapping agent (%) | 6.3 | 8.3 | 8.0 | 10.0 | 12.5 | 16.7 | 20.0 | 50.0 | 66.7 | — |

*1EP331: JSR Corporation
*2HT-1066: JSR Corporation

TABLE 3

| Example No. | Rubber No. | Ink No. | Insoluble compound evaluation |
|---|---|---|---|
| 1 | 1 | 1 | AA |
| 2 | 1 | 2 | AA |
| 3 | 1 | 3 | AA |
| 4 | 2 | 1 | A |
| 5 | 2 | 2 | AA |
| 6 | 2 | 3 | AA |
| 7 | 3 | 1 | AA |
| 8 | 3 | 2 | AA |
| 9 | 3 | 3 | AA |
| 10 | 4 | 1 | A |
| 11 | 4 | 2 | AA |
| 12 | 4 | 3 | AA |
| 13 | 5 | 1 | A |
| 14 | 5 | 2 | AA |
| 15 | 5 | 3 | AA |
| 16 | 6 | 1 | A |
| 17 | 6 | 2 | A |
| 18 | 6 | 3 | AA |
| 19 | 7 | 1 | A |
| 20 | 7 | 2 | A |
| 21 | 7 | 3 | AA |
| 22 | 8 | 1 | A |
| 23 | 8 | 2 | AA |
| 24 | 8 | 3 | AA |
| 25 | 9 | 1 | C |
| 26 | 9 | 2 | C |
| 27 | 9 | 3 | A |
| 28 | 10 | 1 | C |
| 29 | 10 | 2 | C |
| 30 | 10 | 3 | C |

TABLE 4

| Example No. | Rubber No. | Ink No. | Insoluble compound evaluation |
|---|---|---|---|
| 31 | 11 | 1 | AA |
| 32 | 11 | 2 | AA |
| 33 | 11 | 3 | AA |
| 34 | 12 | 1 | AA |
| 35 | 12 | 2 | AA |
| 36 | 12 | 3 | AA |
| 37 | 13 | 1 | A |
| 38 | 13 | 2 | AA |
| 39 | 13 | 3 | AA |
| 40 | 14 | 1 | A |
| 41 | 14 | 2 | AA |
| 42 | 14 | 3 | AA |
| 43 | 15 | 1 | A |
| 44 | 15 | 2 | A |
| 45 | 15 | 3 | AA |
| 46 | 16 | 1 | A |
| 47 | 16 | 2 | AA |
| 48 | 16 | 3 | AA |
| 49 | 17 | 1 | A |
| 50 | 17 | 2 | A |
| 51 | 17 | 3 | AA |
| 52 | 18 | 1 | A |
| 53 | 18 | 2 | A |
| 54 | 18 | 3 | AA |
| 55 | 19 | 1 | C |
| 56 | 19 | 2 | C |
| 57 | 19 | 3 | A |
| 58 | 20 | 1 | C |
| 59 | 20 | 2 | C |
| 60 | 20 | 3 | C |

When ethylene-propylene diene rubber polymer is used as the rubber base polymer, the trapping agent is particularly effective in amounts of from about 10 to about 80 parts by weight, based on 100 parts by weight of the rubber base polymer (Table 3, rubber Nos. 1 to 8). When isobutylene-isoprene rubber polymer is used as the rubber base polymer, the trapping agent is particularly effective in amounts of from about 5 to about 40 parts by weight, based on 100 parts by weight of the rubber base polymer (Table 4, rubber Nos. 11 to 18). For either rubber base polymer, when using inks having higher penetration force (e.g., ink no. 1), results are more favorable when the total amount of vulcanization accelerator and lubricant are about 50 wt % or less of the total amount of the trapping agent.

The invention is not limited to the embodiments described in the Examples, which are provided for illustrative purposes only. It will be apparent that various modifications can be made without departing from the spirit and the scope of the invention as described and claimed herein.

What is claimed is:

1. An inkjet recording apparatus comprising:

an ink tank;

an ink-jet head having at least one ink-jet head nozzle; and a rubber member in at least one ink flow passage, wherein the rubber member comprises a rubber composition having an ethylene-propylene diene rubber base polymer, and a trapping agent selected from the group consisting of calcium carbonate, silicon dioxide, talc, clay, and mixtures thereof.

2. The ink-jet recording apparatus of claim 1, wherein the trapping agent is present in an amount of from about 10 parts to about 80 parts by weight, based on 100 parts by weight of the ethylene-propylene diene rubber base polymer.

3. The ink-jet recording apparatus of claim 2, wherein the rubber composition further comprises carbon black.

4. The ink-jet recording apparatus of claim 2, wherein the rubber composition further comprises a vulcanization accelerator and a lubricant, wherein a total amount of the vulcanization accelerator and the lubricant is in an amount of about 50% by weight or less, based on the total amount of the trapping agent.

5. The ink-jet recording apparatus of claim 4, wherein the lubricant is at least one of fatty acid salts and fatty acid derivatives.

6. The ink-jet recording apparatus of claim 4, wherein the lubricant is at least one stearic acid salt.

7. The ink-jet recording apparatus of claim 1, wherein the rubber composition comprises calcium carbonate as a trapping agent and at least one stearic acid salt as a lubricant.

8. The ink-jet recording apparatus of claim 1, wherein the rubber member is at least one of a cap for covering the ink-jet head nozzle, a wiper for cleaning an end face of the ink- jet head nozzle, a seal packing to be pinched between parts at a juncture, and a tube for supplying ink from the ink tank to the ink-jet head.

9. The ink-jet recording apparatus of claim 1, wherein the rubber composition further comprises paraffin oil.

10. The ink-jet recording apparatus of claim 1, wherein ethylene-propylene diene rubber polymer is present in an amount of from 45.6% to 48.1% by weight, based on the rubber composition.

11. The ink-jet recording apparatus of claim 1, wherein the rubber composition further comprises calcium carbonate as a trapping agent, zinc oxide and sulfur as a vulcanization agent, tetramethyl thiuram disulfide as a vulcanization accelerator, calcium stearate as a lubricant, and paraffin oil as a softening agent, wherein the calcium carbonate is present in an amount of from 10 to 80 parts by weight based on 100 parts by weight of the ethylene-propylene diene rubber polymer, and tetramethyl thiuram disulfide and stearate calcium are present in an amount of 50 parts by weight or less based on the total weight of the calcium carbonate.

* * * * *